US007228975B2

(12) United States Patent
Yang et al.

(10) Patent No.: US 7,228,975 B2
(45) Date of Patent: Jun. 12, 2007

(54) DISH RACK WITH SWINGING ARM

(75) Inventors: Frank Yang, Rancho Palos Verdes, CA (US); Adam C. Wade, Rancho Santa Margarita, CA (US); Myk Wayne Lum, Irvine, CA (US)

(73) Assignee: Simplehuman LLC, Torrence, CA (US)

( * ) Notice: Subject to any disclaimer, the term of this patent is extended or adjusted under 35 U.S.C. 154(b) by 310 days.

(21) Appl. No.: 10/830,583

(22) Filed: Apr. 22, 2004

(65) Prior Publication Data

US 2005/0236344 A1 Oct. 27, 2005

(51) Int. Cl.
*A47G 19/08* (2006.01)

(52) U.S. Cl. ..... 211/41.4

(58) Field of Classification Search ..... 211/41.2–41.9, 211/88, 171, 126.16, 132.1, 133.5, 133.6
See application file for complete search history.

(56) References Cited

U.S. PATENT DOCUMENTS

| | | | | |
|---|---|---|---|---|
| 591,377 | A | | 10/1897 | Bunce |
| 1,604,608 | A | | 10/1926 | Ryerson |
| 1,682,654 | A | | 8/1928 | Andrews |
| D97,654 | S | | 11/1935 | Watral |
| 2,479,118 | A | | 8/1949 | Jenness |
| 2,516,088 | A | * | 7/1950 | Einhorn ..... 211/41.5 |
| 2,708,037 | A | * | 5/1955 | Planeta ..... 211/74 |
| 2,739,715 | A | | 3/1956 | Planeta |
| 2,841,288 | A | * | 7/1958 | Field et al. ..... 211/41.4 |
| 2,864,509 | A | | 12/1958 | Watral |
| 2,885,087 | A | | 5/1959 | Bliss |
| 2,886,087 | A | | 5/1959 | Pasinski |
| 2,936,898 | A | | 5/1960 | Miguez |
| D189,311 | S | | 11/1960 | Christoffersen |
| 3,203,557 | A | | 8/1965 | Ettlinger, Jr. |
| 3,217,890 | A | | 11/1965 | Maslow |
| 3,433,363 | A | | 3/1969 | Clearman |
| 3,752,322 | A | * | 8/1973 | Fiocca et al. ..... 211/41.8 |
| 3,941,273 | A | | 3/1976 | Dalencon |
| 3,960,290 | A | | 6/1976 | Yake et al. |
| 4,046,261 | A | * | 9/1977 | Yake ..... 211/41.8 |
| D271,339 | S | | 11/1983 | Lee |
| 4,606,464 | A | * | 8/1986 | Jordan et al. ..... 211/41.8 |
| 4,635,799 | A | | 1/1987 | Penner |
| 4,726,475 | A | * | 2/1988 | Ferenzi ..... 211/41.5 |
| 4,830,200 | A | * | 5/1989 | Zambano et al. ..... 211/133.5 |
| D306,926 | S | | 3/1990 | Heller et al. |
| 4,974,806 | A | | 12/1990 | Matern |
| D321,771 | S | | 11/1991 | Cavicchia |
| 5,119,943 | A | | 6/1992 | Hoang |
| 5,158,185 | A | * | 10/1992 | Michael et al. ..... 211/41.8 |
| 5,205,419 | A | * | 4/1993 | Purtilo ..... 211/41.8 |
| 5,249,590 | A | * | 10/1993 | Jacobus et al. ..... 134/135 |
| D347,718 | S | | 6/1994 | Craft et al. |
| 5,344,029 | A | * | 9/1994 | Oghia et al. ..... 211/41.8 |
| D353,921 | S | | 12/1994 | Lippisch et al. |
| 5,431,294 | A | | 7/1995 | Stottmann et al. |

(Continued)

*Primary Examiner*—Jennifer E. Novosad
(74) *Attorney, Agent, or Firm*—Raymond Sun

(57) ABSTRACT

A dish rack has a wire frame base, a horizontal wire segment coupled to the wire frame base, and a swinging arm pivotably coupled to the horizontal wire segment. The swinging arm has a plurality of holders and a lock mechanism that removably engages the swinging arm with a portion of the wire frame base.

17 Claims, 8 Drawing Sheets

U.S. PATENT DOCUMENTS

D363,578 S 10/1995 Brightbill et al.
D370,323 S 5/1996 Lafond
D373,866 S 9/1996 Belden et al.
D376,882 S 12/1996 Cook
5,588,539 A 12/1996 Belden, Jr. et al.
5,605,236 A 2/1997 Welch
5,649,630 A * 7/1997 Remmler ..... 211/41.8
5,704,492 A 1/1998 Bartko
D391,696 S 3/1998 Bournay et al.
5,775,518 A 7/1998 Connor
D398,725 S 9/1998 Merkel
D408,603 S 4/1999 Haley
D423,160 S 4/2000 Lenney
6,109,455 A 8/2000 Schroeder
6,123,204 A * 9/2000 Nelson et al. ..... 211/41.9
D439,716 S 3/2001 Wright
D448,132 S 9/2001 Wolfenden
6,325,220 B1 * 12/2001 Malmstrom ..... 211/41.8
6,364,130 B2 4/2002 Wright
6,364,131 B1 4/2002 Moylan
6,371,312 B1 4/2002 Tsuchida
6,516,956 B2 * 2/2003 Martorella et al. ..... 211/41.6
6,571,965 B1 * 6/2003 Beck et al. ..... 211/41.8
6,659,406 B2 12/2003 Tsuchida
D488,891 S 4/2004 Simth et al.
6,848,585 B2 * 2/2005 VanLandingham ..... 211/41.9
2002/0185166 A1 12/2002 Rosenbauer et al.
2003/0089672 A1 * 5/2003 VanLandingham ..... 211/41.8

* cited by examiner

DISH RACK WITH SWINGING ARM

BACKGROUND OF THE INVENTION

1. Field of the Invention

The present invention relates to dish racks and their accessories, and in particular, to a dish rack having a multi-purpose swinging arm which can be manipulated to hold wine glasses and large utensils.

2. Description of the Prior Art

Dish racks are commonly used in dishwashers for organizing and positioning plates, bowls, cups and utensils for washing. Dish racks are also commonly used on kitchen countertops for positioning plates, bowls, cups and utensils to let them dry after they have been washed.

SUMMARY OF THE DISCLOSURE

It is an object of the present invention to provide a dish rack that has greater utility than conventional dish racks.

It is another object of the present invention to provide a dish rack that can effectively hold a variety of different objects.

In order to accomplish the objects of the present invention, the present invention provides a dish rack having a wire frame base, a horizontal wire segment coupled to the wire frame base, and a swinging arm pivotably coupled to the horizontal wire segment, the swinging arm having a plurality of holders and a lock mechanism that removably engages the swinging arm with a portion of the wire frame base.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
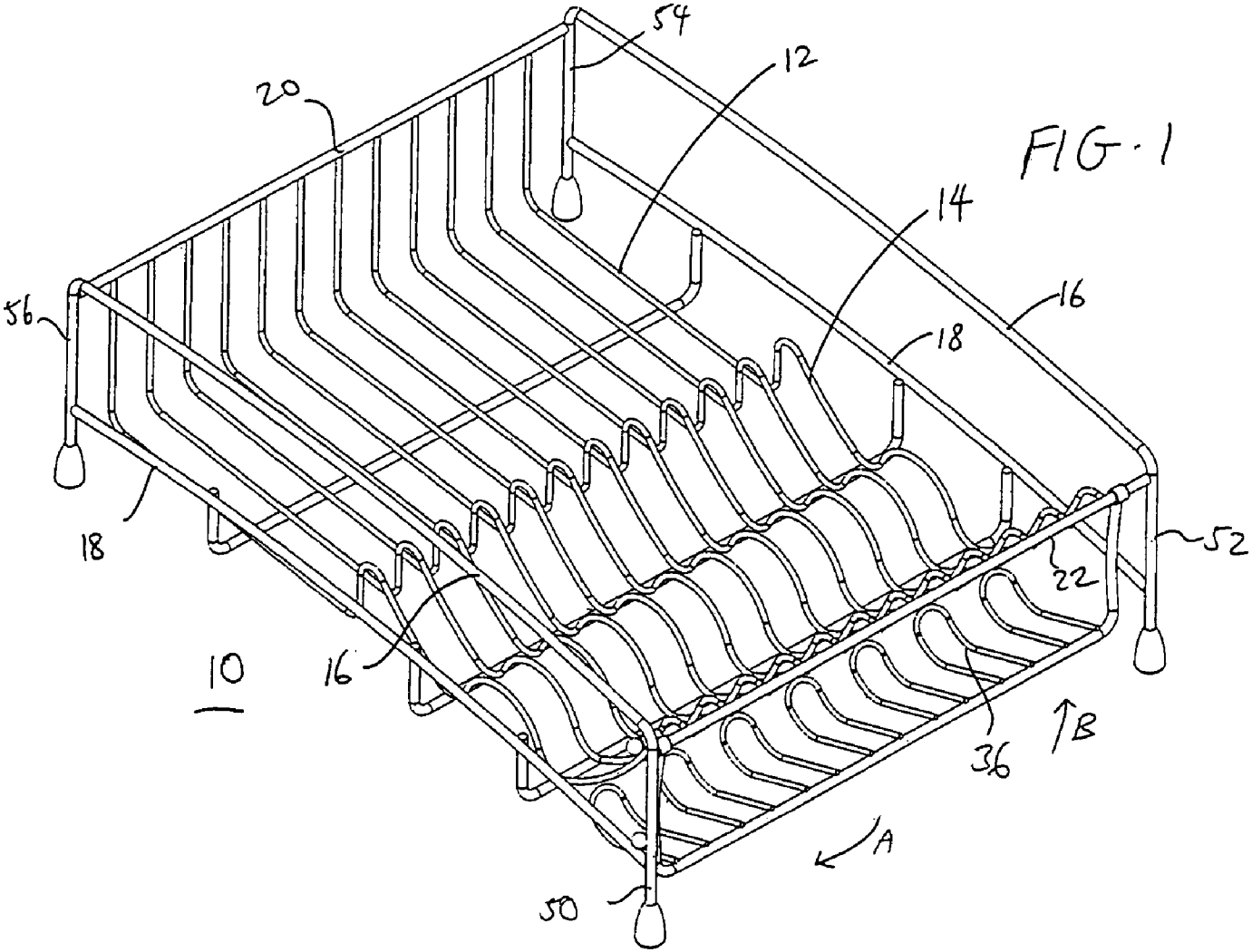
FIG. 1 is a perspective view of a dish rack according to one embodiment of the present invention shown with the swinging arm locked in the lowered position.

FIG. 1 illustrates a dish rack 10 according to the present invention. The dish rack 10 can have the typical components of a conventional dish rack, including, but not limited to, a wire frame base 12 for receiving plates and large bowls, and a divider section along the wire frame base 12 that has a plurality of divider walls 14 for receiving plates. Two sets of horizontal side wire segments 16 and 18 form one of two opposing sides of the four-sided dish rack 10, and two horizontal end wire segments 20 and 22 form the other two opposing sides of the four-sided dish rack 10. Four legs 50, 52, 54 and 56 are provided, with each leg extending vertically from an end of each of the pairs of horizontal side wire segments 16 and 18. A swinging arm 24 is pivotably coupled to the front end wire segment 22. Although FIG. 1 illustrates the swinging arm 24 being coupled to the wire segment 22, it is possible to couple the swinging arm 24 to any of the wire segments 16, 18, 20 and 22, assuming that the wire frame base 12 is configured to facilitate the raising and lowering of the swinging arm 24.

The swinging arm 24 and its operation are best illustrated in connection with FIGS. 2–7. The swinging arm 24 has a U-shaped configuration with a longitudinal wire portion 26 that connects two parallel side wire portions 28 and 30. A sleeve 32 and 34 is provided at the end of each wire portion 28 and 30, respectively, with the sleeves 32, 34 adapted to receive the end wire segment 22 to form a pivoting and sliding connection between the swinging arm 24 and the end wire segment 22. A plurality of curved U-shaped holders 36 extend from the longitudinal wire portion 26, with a space 38 defined between adjacent holders 36. A wine glass or other object can be slid into each separate space 38, so that the adjacent holders 36 can suspend or hold the wine glass or object. In addition, a first locking bulb 40 is connected adjacent the sleeve 32 via a first shaft 44, and a second locking bulb 42 is connected along the wire portion 28 via a second shaft 46. The second locking bulb 42 is spaced apart from the first locking bulb 40. Both locking bulbs 40, 42 extend away from the interior of the swinging arm 24. While two locking bulbs 40, 42 are illustrated herein, any number of locking bulbs (e.g., one, three or more) can be utilized as well.

Figure 2:
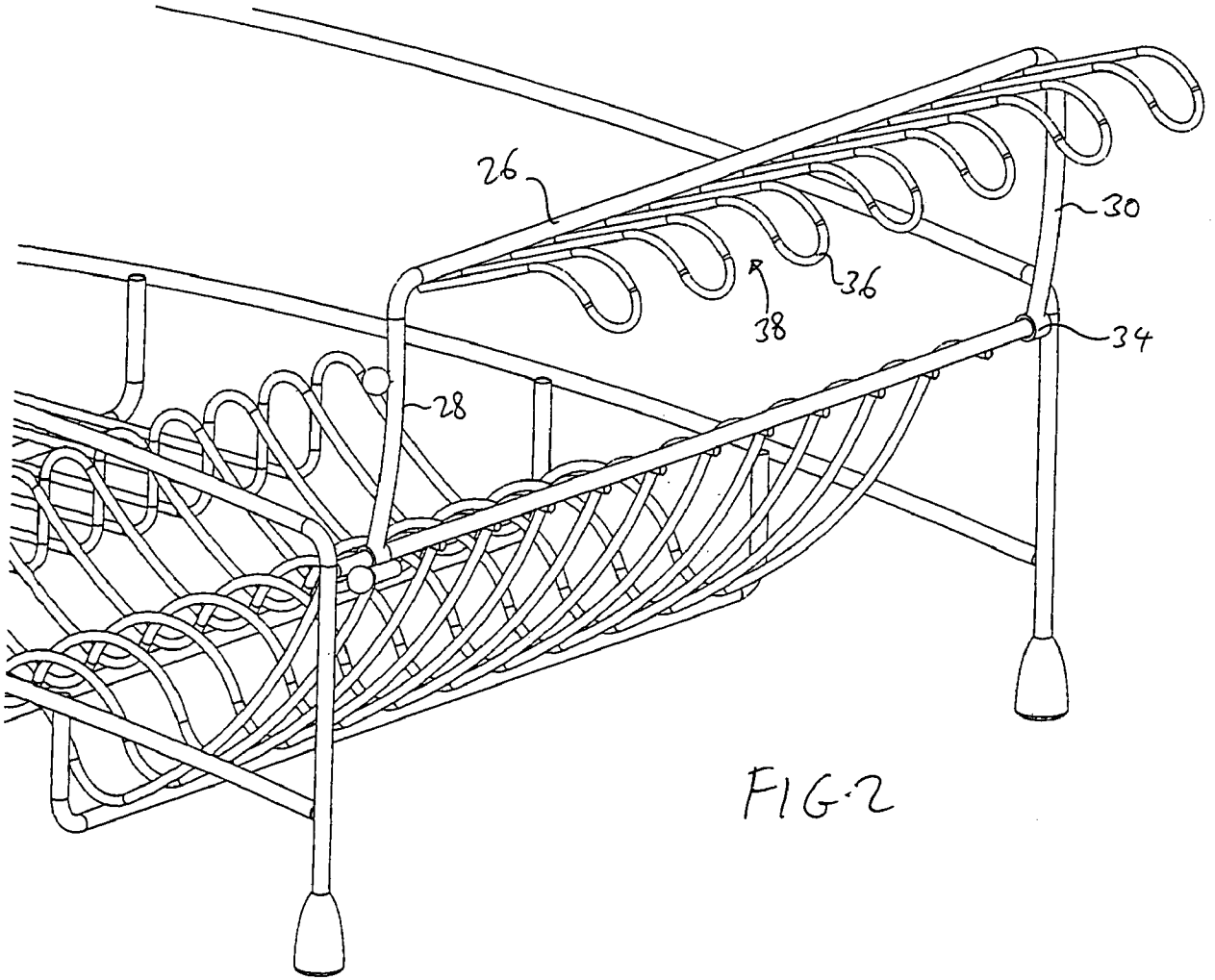
FIG. 2 is an enlarged perspective view of a portion of the dish rack of FIG. 1 shown with the swinging arm in the raised position.
Figure 3:
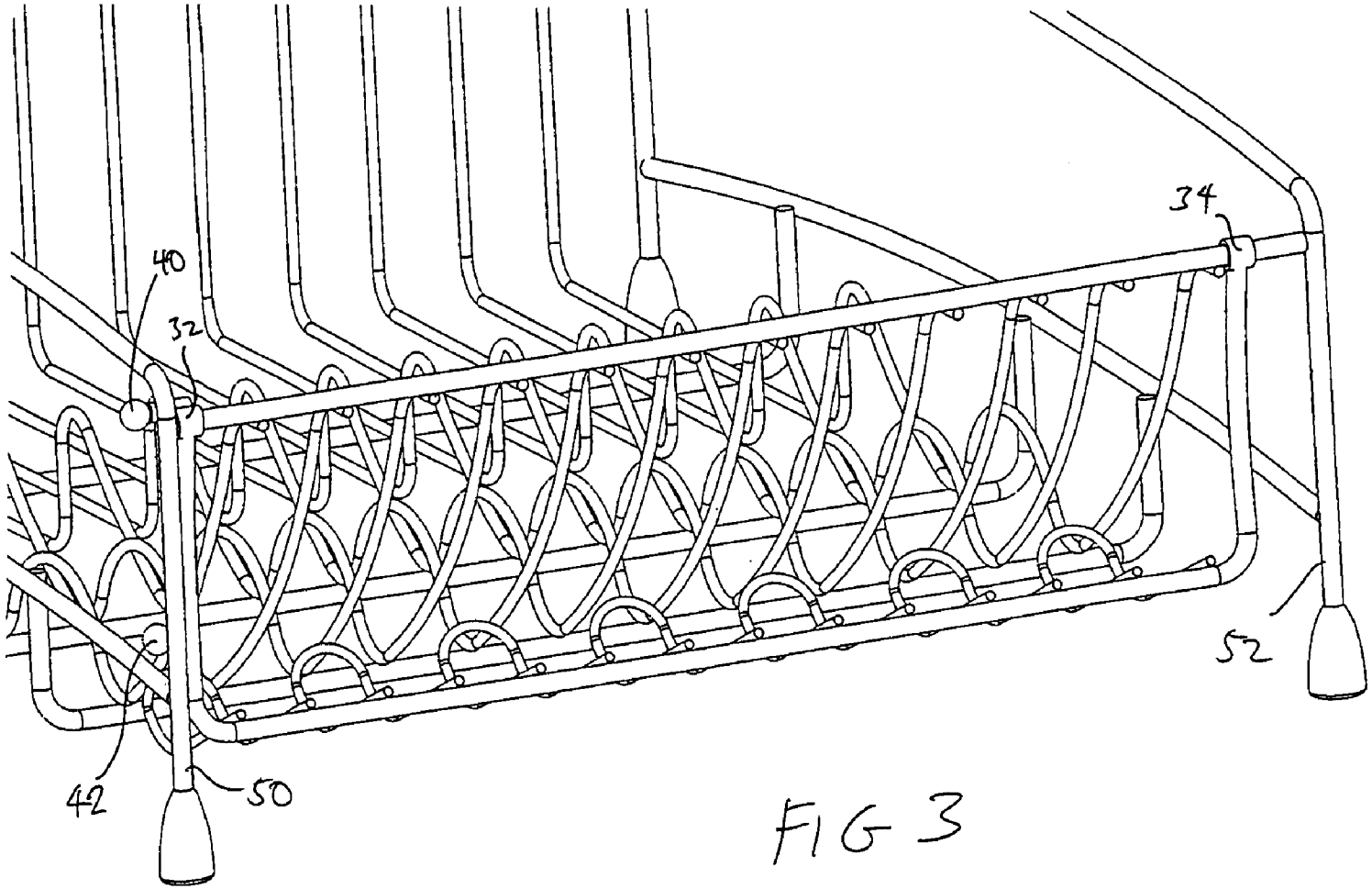
FIG. 3 is an enlarged perspective view of a portion of the dish rack of FIG. 1 shown with the swinging arm locked in the lowered position.
Figure 4:
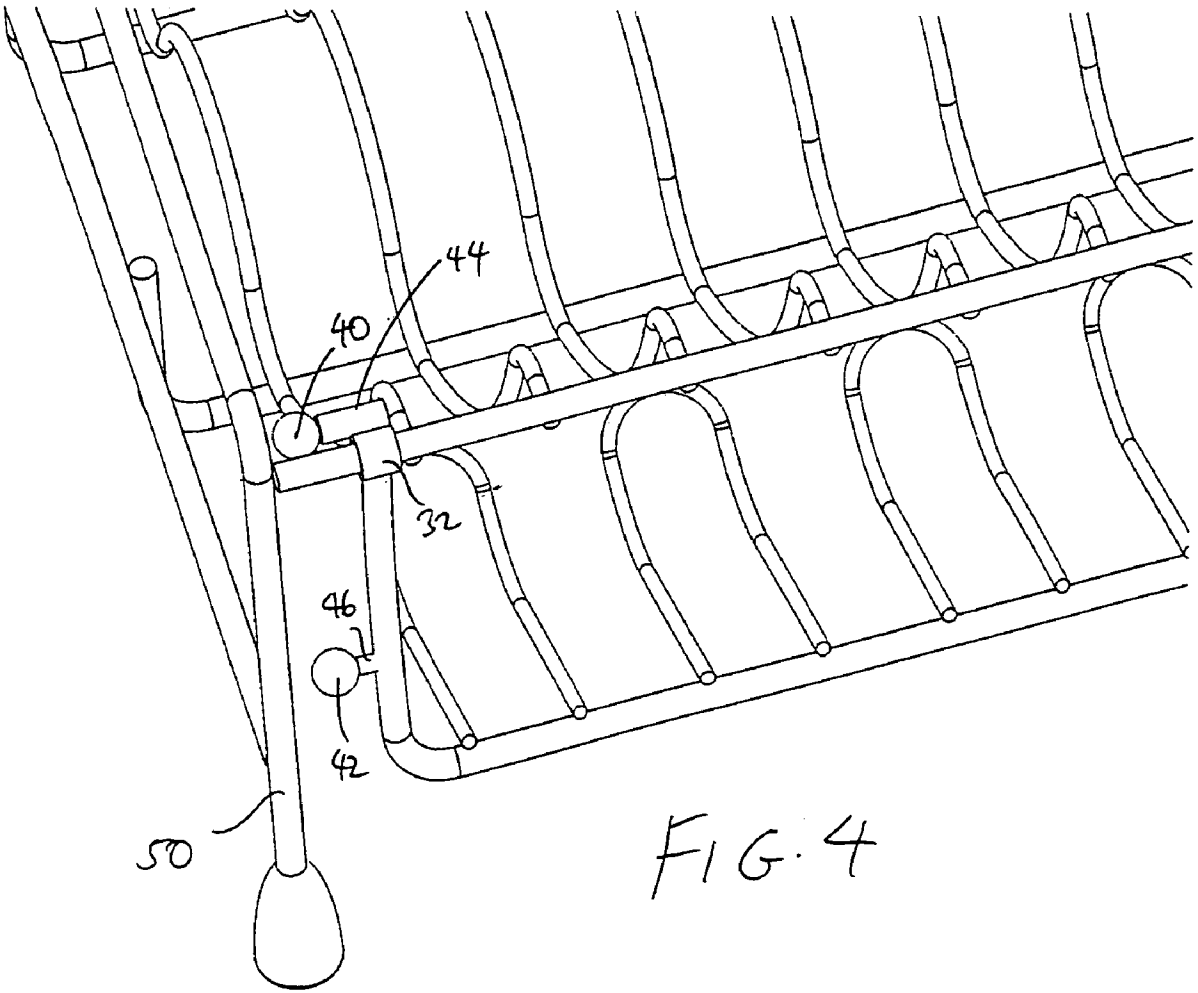
FIG. 4 is an enlarged perspective view of a corner of the dish rack of FIG. 1 shown with the swinging arm unlocked in the lowered position.
Figure 5:
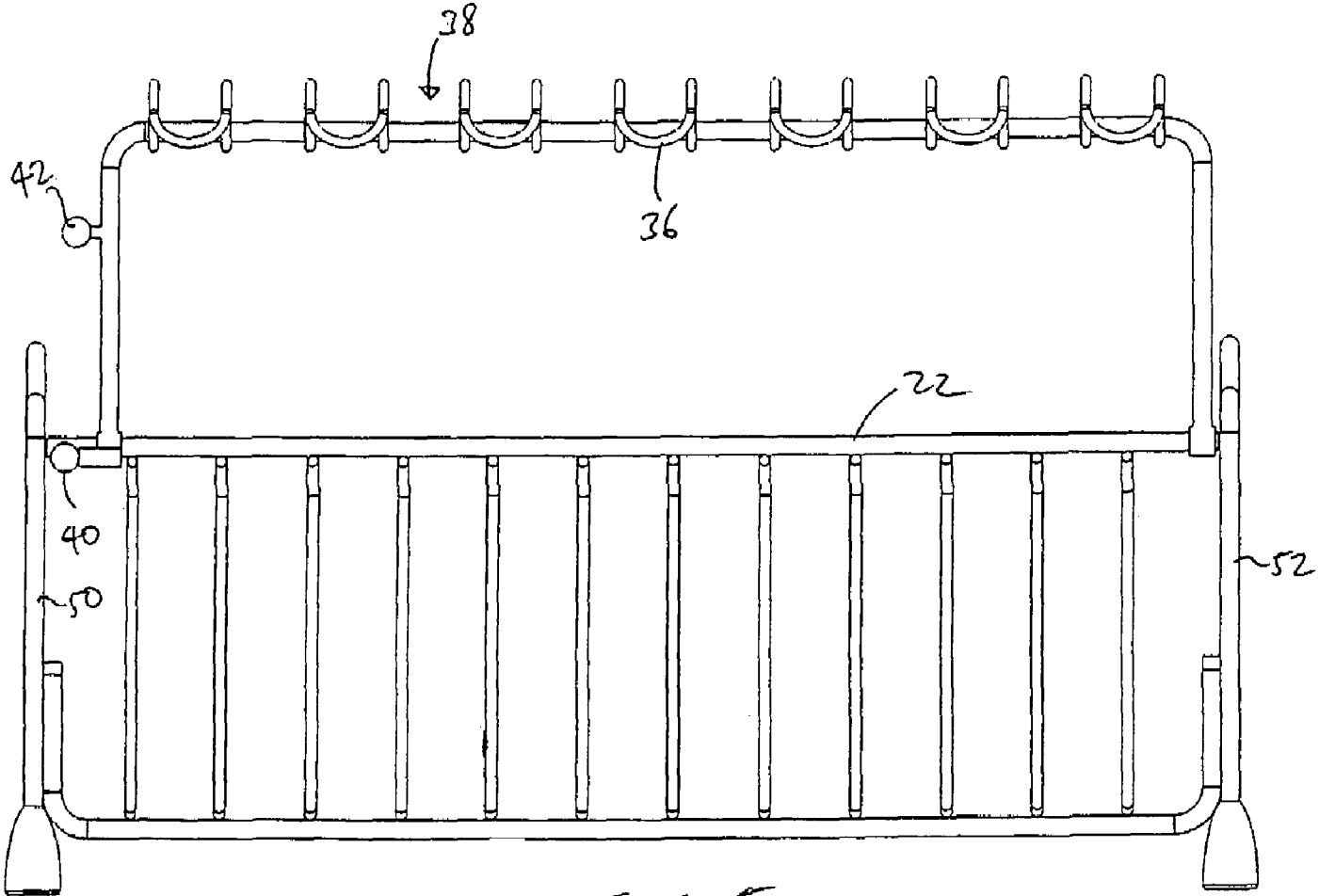
FIG. 5 is a front plan view of the dish rack of FIG. 1 shown with the swinging arm in the raised position.
Figure 6:
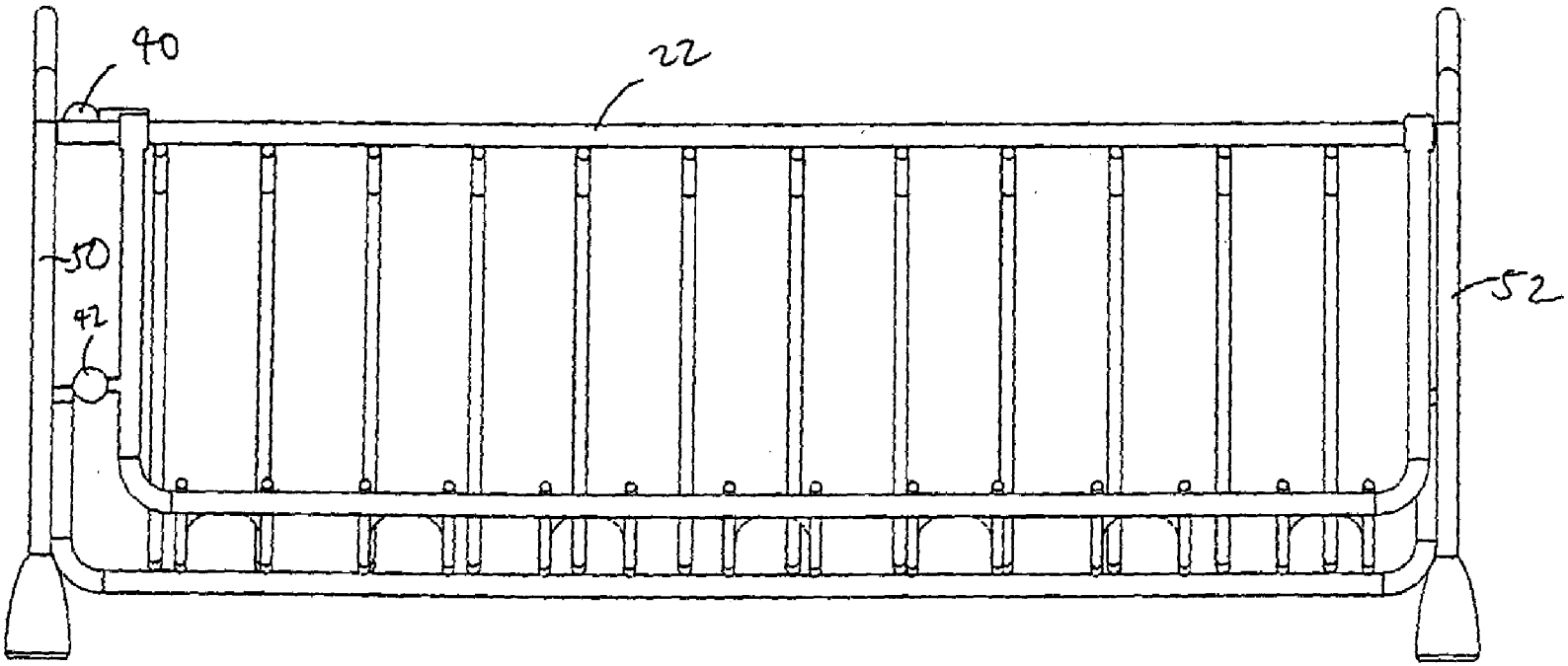
FIG. 6 is a front plan view of the dish rack of FIG. 1 shown with the swinging arm unlocked in the lowered position.
Figure 7:
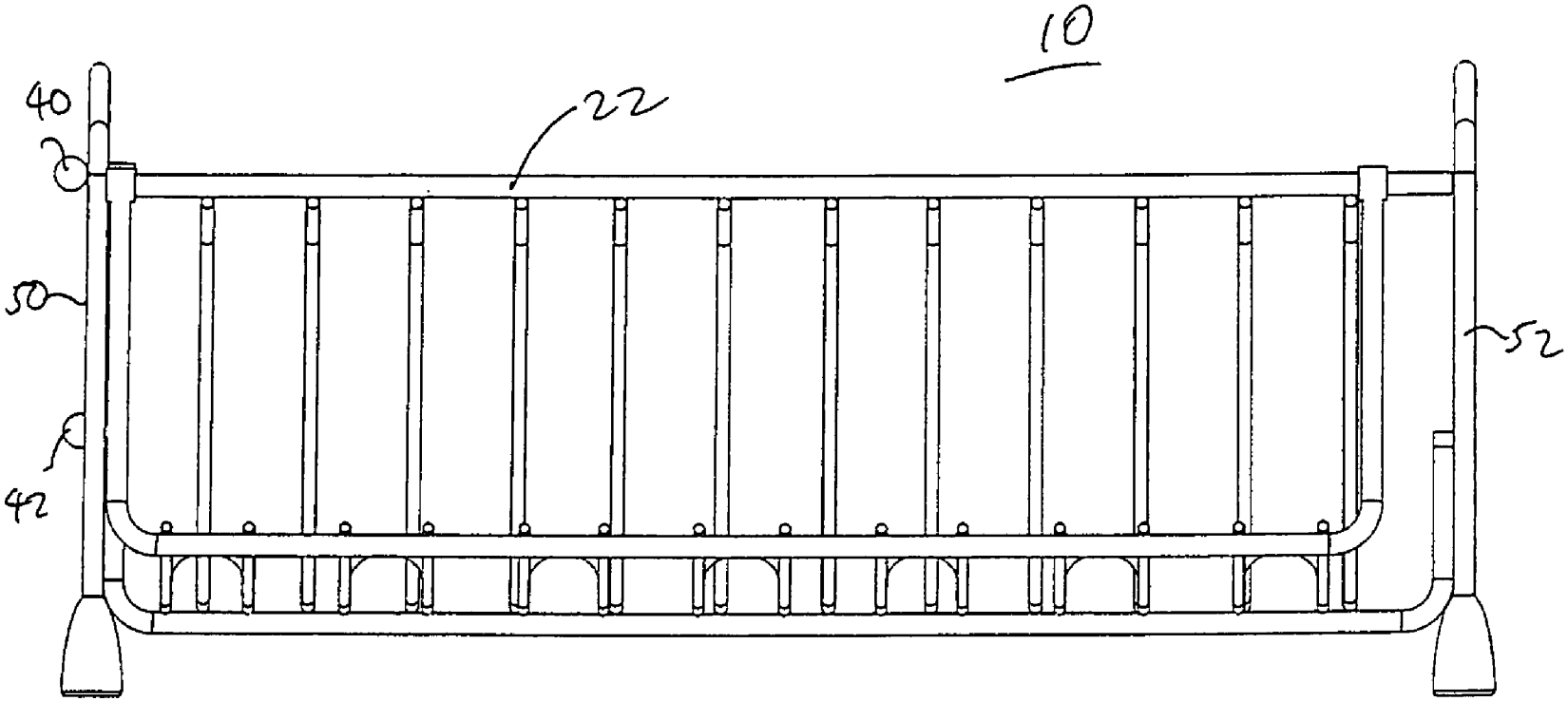
FIG. 7 is a front plan view of the dish rack of FIG. 1 shown with the swinging arm locked in the lowered position.

FIGS. 1, 3 and 7 illustrate the swinging arm 24 in a locked lower position. In this position, each holder 36 defines a convex holding space (see FIG. 1), and the plurality of holders 36 define an elongated convex holding space that is adapted to hold large or long utensils (e.g., a knife, chopsticks, etc.). FIGS. 2 and 5 illustrate the swinging arm 24 in a raised position, where wine glasses can be held in the spaces 38 by the adjacent holders 36.

When the swinging arm 24 is in the locked lower position, the locking bulbs 40, 42 engage the leg 50 so as to prevent the swinging arm 24 from experiencing any pivoting motion. As best shown in FIGS. 1, 3 and 7, the swinging arm 24 is pivoted downwardly and inwardly (see the direction of arrow A) about the pivot axis of the wire segment 22 so that the locking bulbs 40, 42 can be passed behind the leg 50, and extend outwardly on the outer side of the leg 50 away from the center of the dish rack 10. The leg 50 blocks the shafts 44 and 46, and the bulbous feature of the locking bulbs 40, 42 act as an engagement mechanism to maintain the locking bulbs 40, 42 on the outward side of the leg 50, and therefore maintain the swinging arm 24 in the locked position.

Figure 8:
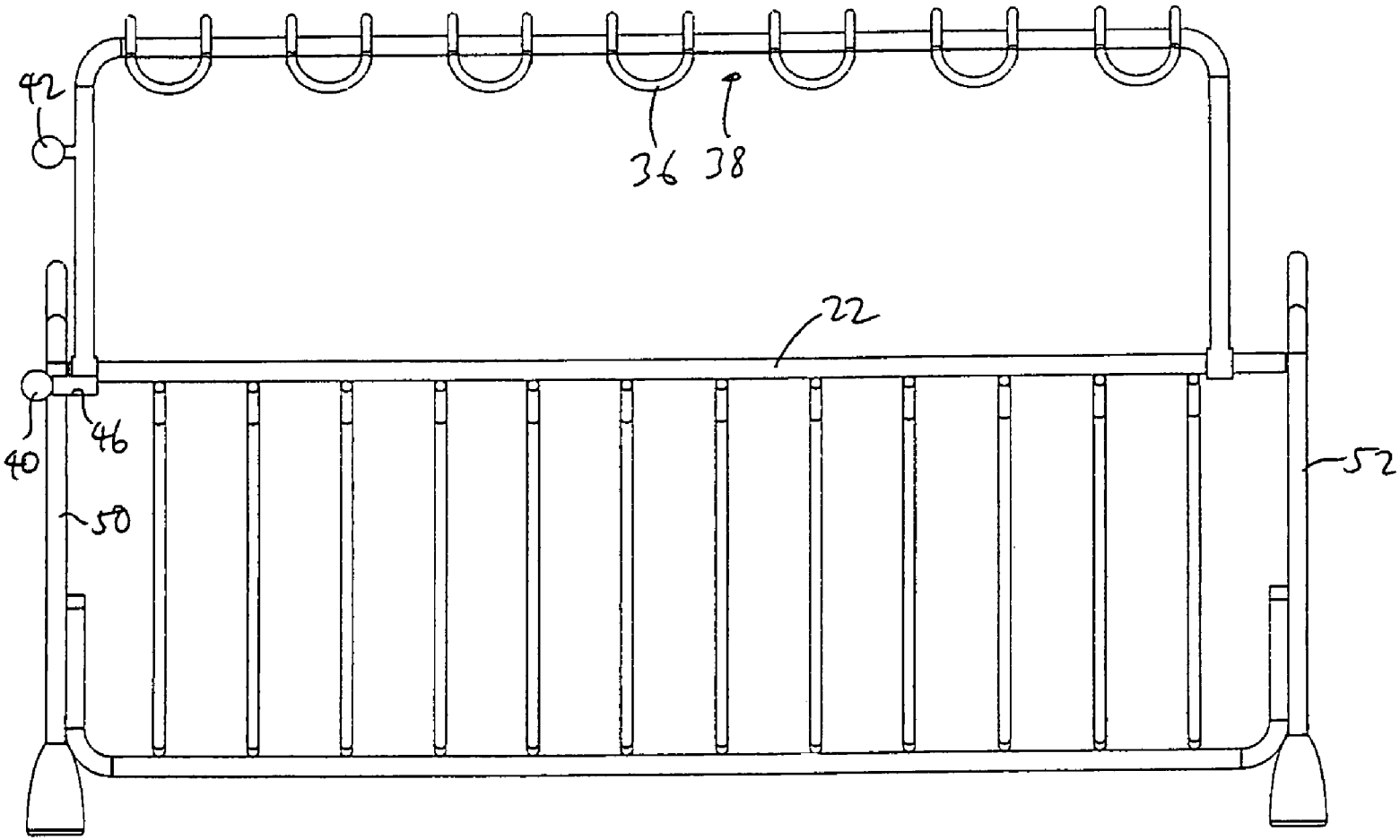
FIG. 8 is a front plan view of the dish rack of FIG. 1 shown with the swinging arm secured in the raised position.

When the user desires to raise the swinging arm 24, the user pivots the swinging arm 24 in the rearward direction (see arrow A), and then slides the swinging arm 24 sideways away from the leg 50 and towards the leg 52. See FIGS. 4 and 6. This sliding motion can be accomplished because the wire segment 22 is slidably received inside the sleeves 32 and 34. This sliding motion also causes the locking bulbs 40, 42 to be slid towards the center of the dish rack 10, and inside the leg 50. When the swinging arm 24 is in this position shown in FIGS. 4 and 6, the locking bulbs 40, 42 are disengaged from the leg 50, so that the swinging arm 24 can be freely pivoted about the wire segment 22. In the next step, the user pivots the swinging arm 24 upwardly in the direction of the arrow B, and raises the swinging arm 24 until the swinging arm 24 reaches the raised position shown in FIGS. 2 and 5. At this point, the user slides the swinging arm 24 towards the leg 50 until the locking bulbs 40, 42 are again to the outside of the leg 50, as shown in FIG. 8. In this secured raised position, the shaft 46 abuts the leg 50 to prevent the swinging arm 24 from pivoting back downwards in the direction of arrow A.

To place the swinging arm 24 back in the locked lower position, the user slides the swinging arm 24 away from the leg 50 and towards the leg 52, and then pivots the swinging arm 24 downwardly in the direction of the arrow A, about the pivot axis of the wire segment 22. The user then slides the swinging arm 24 towards the leg 50, and then pivots the swinging arm 24 inwardly so that the locking bulbs 40, 42 are passed behind the leg 50, and extend outwardly on the outer side of the leg 50 away from the center of the dish rack 10.

Thus, the swinging arm 24 provides a dual-retention mechanism that can be used to hold different types of objects. The swinging arm 24 can be deployed conveniently and quickly.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A wire frame dish rack, comprising:

a wireframe having a base, the wireframe further including four vertical walls that define a periphery, with one of the vertical walls having a horizontal wire segment; and a swinging arm having a plurality of holders, the swinging arm pivotably coupled to the horizontal wire segment and pivotable between a locked raised position and a locked lowered position;

wherein the swinging arm has a lock mechanism that removably engages the swinging arm with a first portion of the wireframe when the swinging arm is in the locked raised position, and removably engages the swinging arm with a second different portion of the wireframe when the swinging arm is in the locked lowered position.

2. The dish rack of claim 1, wherein the swinging arm includes a sleeve for retaining the horizontal wire segment.

3. The dish rack of claim 1, wherein a plurality of spaces are defined between adjacent holders.

4. The dish rack of claim 1, wherein each holder defines a convex holding space.

5. The dish rack of claim 1, wherein the lock mechanism comprises a bulbous element connected to the swinging arm by a shaft.

6. The dish rack of claim 1, wherein the swinging arm is positioned outside the periphery of the four walls when in the raised position, and the swinging arm is positioned inside the periphery of the four walls when in the lowered position.

7. The dish rack of claim 1, wherein the swinging arm is positioned inside the periphery of the four walls, but below the base, when in the lowered position.

8. A wire frame dish rack, comprising:

a wireframe having a base, the wireframe further including four vertical walls that define a periphery, with one of the vertical walls having a horizontal wire segment; and a swinging arm having a plurality of holders, the swinging arm pivotably coupled to the horizontal wire segment and pivotable between a locked raised position and a locked lowered position;

wherein the wireframe further includes a plurality of legs, and wherein the swinging arm has a lock mechanism that removably engages the swinging arm with a first portion of a leg when the swinging arm is in the locked raised position, and removably engages the swinging arm with a second different portion of the same leg when the swinging arm is in the locked lowered position.

9. The dish rack of claim 8, wherein the lock mechanism comprises a bulbous element connected to the swinging arm by a shaft.

10. The dish rack of claim 8, wherein the swinging arm is positioned inside the periphery of the four walls, but below the base, when in the lowered position.

11. A wire frame dish rack, comprising:

a wireframe having a base, the wireframe further including four vertical walls that define a periphery, with one of the vertical walls having a horizontal wire segment; and a swinging arm having a plurality of holders, the swinging arm pivotably coupled to the horizontal wire segment and pivotable between a raised position and a lowered position;

wherein the swinging arm is positioned inside the periphery of the four walls, but below the base, when in the lowered position; and wherein each holder defines a convex holding space.

12. The dish rack of claim 11, wherein the swinging arm includes a sleeve for retaining the horizontal wire segment.

13. The dish rack of claim 11, wherein a plurality of spaces are defined between adjacent holders.

14. The dish rack of claim 11, wherein the swinging arm is positioned outside the periphery of the four walls when in the raised position, and the swinging arm is positioned inside the periphery of the four walls when in the lowered position.

15. A wire frame dish rack, comprising:

a wireframe having a base, the wireframe further including four vertical walls that define a periphery, with one of the vertical walls having a horizontal wire segment, and with a plurality of legs extending from the wireframe; and a swinging arm having a plurality of holders, and a locking element extending from the swinging arm, the swinging arm pivotably coupled to the horizontal wire segment and pivotable between a raised position and a lowered position, with the locking element abutting one of the legs when the swinging arm is in the lowered position to prevent the swinging arm from pivoting upwardly.

16. The dish rack of claim 15, wherein the locking element abuts one of the legs when the swinging arm is in the raised position to prevent the swinging arm from pivoting downwardly.

17. The dish rack of claim 15, wherein the swinging arm is slidable in a sideways direction.

* * * * *